US005265392A

United States Patent [19]

Pedrocco

[11] Patent Number: 5,265,392

[45] Date of Patent: Nov. 30, 1993

[54] ASEISMATIC SUPPORT FOR CONSTRUCTIONS SUBJECT TO HIGH THERMAL DEFORMATIONS

[75] Inventor: Giuseppe Pedrocco, Milan, Italy

[73] Assignee: Tesit S.p.A., Milan, Italy

[21] Appl. No.: 990,809

[22] Filed: Dec. 14, 1992

Related U.S. Application Data

[63] Continuation of Ser. No. 934,893, Aug. 26, 1992, abandoned, which is a continuation of Ser. No. 549,198, Jul. 5, 1990, abandoned.

[30] Foreign Application Priority Data

Jul. 5, 1989 [IT] Italy ..... 21099 A/89

[51] Int. Cl.[5] ..... E04H 9/00

[52] U.S. Cl. ..... 52/167; 14/73.1

[58] Field of Search ..... 52/573, 167 R, 167 DF; 248/605, 633, 636, 90; 14/16.1, 16.5

[56] References Cited

U.S. PATENT DOCUMENTS

| | | | |
|---|---|---|---|
| 2,210,051 | 8/1940 | Woodbury | 248/562 |
| 3,242,877 | 3/1966 | Hirst et al. | 248/614 |
| 3,245,328 | 4/1966 | Fassbinder | 52/396 |
| 3,397,856 | 8/1968 | Sullivan et al. | 248/615 |
| 3,418,328 | 12/1968 | Cardan | 52/167 |
| 3,974,614 | 8/1976 | Strong | 52/573 |
| 4,030,156 | 6/1977 | Raymond | 52/573 |
| 4,852,029 | 7/1989 | Pope et al. | 364/506 |

*Primary Examiner*—James L. Ridgill, Jr.

[57] ABSTRACT

An aseismatic support includes a mass of silicone gel disposed between supported and supporting portions. The silicone gel is plastically deformable under slow movements such as those induced by thermal expansions and stiff under fast movements such as movements caused by earthquakes. The aseismatic support therefore accomodates both thermal and earthquake induced movements.

9 Claims, 1 Drawing Sheet

ASEISMATIC SUPPORT FOR CONSTRUCTIONS SUBJECT TO HIGH THERMAL DEFORMATIONS

This application is a continuation of application Ser. No. 07/934,893, filed Aug. 26, 1992, now abandoned, which is a continuation of Ser. No. 07/549,198, filed Jul. 5, 1990, now abandoned.

BACKGROUND OF THE INVENTION

The present invention concerns an aseismatic support specially suitable for constructions subject to displacements of high degree towards a direction, in particular due to thermal dilatations.

For example, even if in a non-limiting way, the invention is applicable to the support of continuous structures on more bearings, such as bridges, viaducts and the like, wherein dilatations or expansions sum up as they move away from the abutment and the displacements in correspondence with the supports consequently become incompatible with the limits of the usual aseismatic supports.

DESCRIPTION OF THE PRIOR ART

The more recently used of the abovesaid supports are in particular bearings presenting an elastically deformable portion and a permanently deformable portion as, for example, those described in the Italian patent application No. 21674-A/83 of Jun. 17, 1983, and formed by alternated elastomer plates and steel plates, with a lead core or central plug. Said lead-elastomer bearings allow to obtain an economic and effective way the dissipation of energy necessary to avoid or minimize the transmission of the seismic displacements to the supported structure. However, these bearings only allow limited relative movements between the base and the supported structure, said limitation being due to the support structure and to the need of always maintaining in any case the operativeness thereof. Therefore, they cannot be used for continuous structures on a plurality of bearings, wherein thermal changes cause dilatations or expansions which sum up and displacements which may become very great as they move away from an abutment.

OBJECT OF THE INVENTION

This being stated, an object of the present invention is to provide an aseismatic support capable of supporting large displacements, for example due to thermal changes, occurring over long periods of time, without which the aseismatic functionality and operativity of the support may be adversely affected.

Another object of the present invention is to provide an aseismatic support provided with the abovesaid characteristics, having a very simple structure which is easily applied and reliable in operation.

SUMMARY OF THE INVENTION

Essentially, for achieving the abovesaid objects and more, the invention concerns an aseismatic support for structures subject to large and slow displacements in one direction, due, for example, to thermal changes. The invention comprises, in combination: a) at least an aseismatic bearing; b) at least an extremely smooth guide arranged between the bearing and the supported structure to allow relative displacements in the one direction; and c) at least a coupling member arranged in a way as to operate parallel to the one direction. The coupling member is disposed between the bearing and the supported structure, to prevent relative displacements at high speed and allow those displacements reduced speed.

The bearing comprises an elastically deformable portion and a permanently deformable portion, preferably of the already known and mentioned lead-elastomer type, with alternated steel and elastomer plates and a central lead plug. The guide with high smoothness may comprise a plate coated with antifriction material (polytetrafluoroethylene or other material) and can be provided with at least a rail extending in the direction of the dilatation or expansion. The coupling member is advantageously formed by a closed cylinder, fixed to one of the elements to be coupled. Inside the cylinder a piston is housed, the stem of which is fixed to the other one of the elements to be coupled so the movements of the piston cause the forced transfer, through a passage of reduced size, a substance of high viscosity, such as silicone gel. The substance of high viscosity preferably flows, during the displacements due to thermal dilatations in a space defined by a gap, between the internal surface of the cylinder and the external surface of the piston.

The invention will now be further described with reference to an embodiment of same, given by way of illustrative and non-limiting example and shown in the accompanying drawings.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
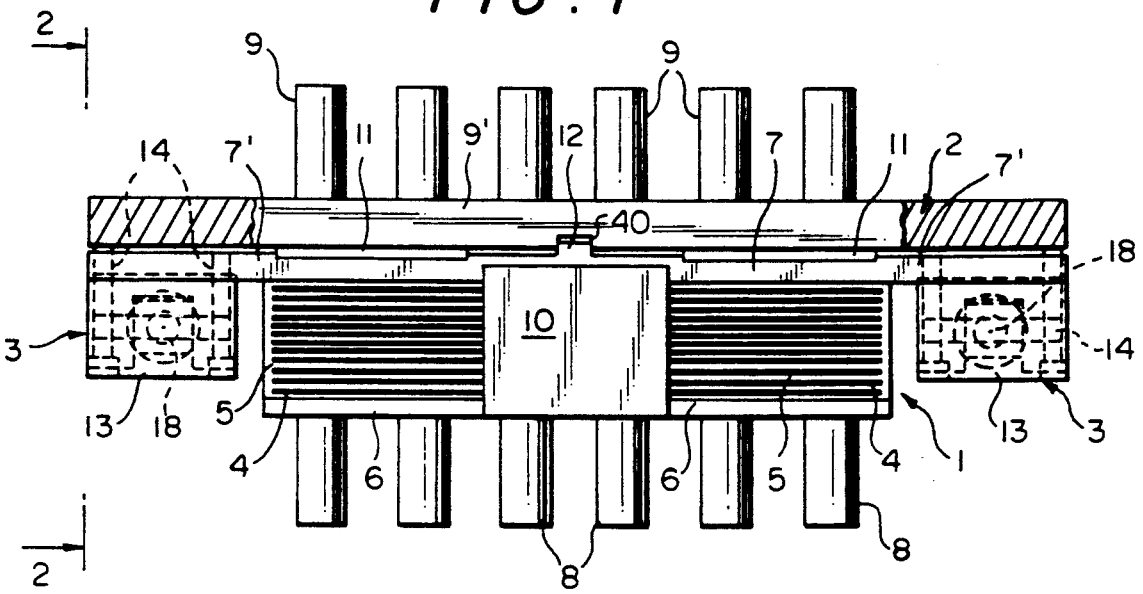
FIG. 1 is a schematic view in elevation of an aseismatic support according to the invention, as seen in a plane perpendicular to the direction of the displacements due to thermal dilatations.
Figure 2:
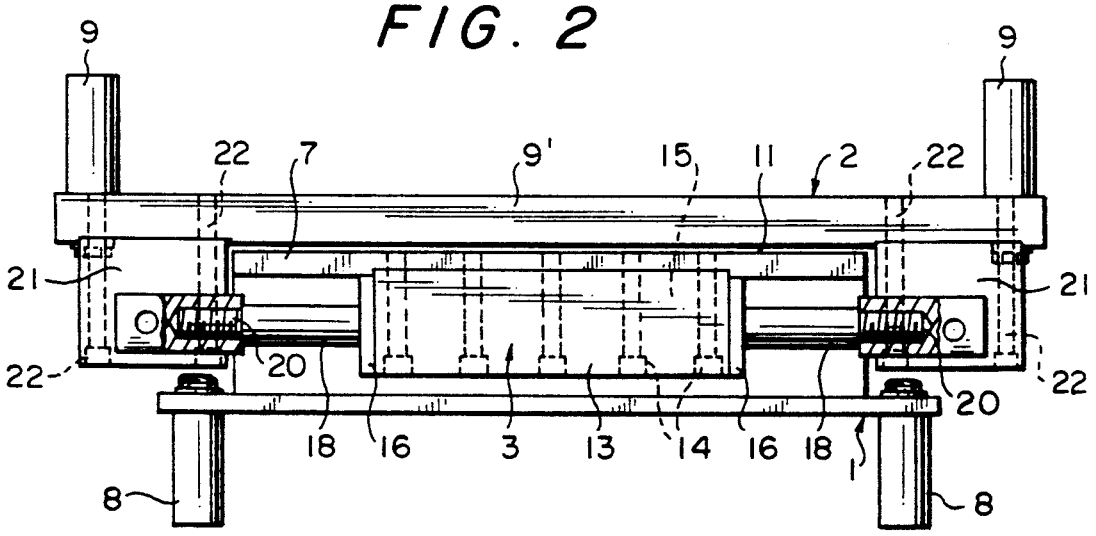
FIG. 2 is a schematic view taken on line 2—2 of the aseismatic support of FIG. 1, in a plane perpendicular to that of FIG. 1.

With reference first to FIGS. 1 and 2, the illustrated support essentially comprises three components, namely an aseismatic bearing or supporting portion 1, a supported portion 2 mounted on the supporting portion 1 and coupling members 3.

The aseismatic bearing or supporting portion 1 for connecting the portion is of a known type and preferably has a permanently or plastically deformable portion. In the illustrated embodiment, the bearing or supporting portion 1 comprises, in a known way, an alternance of elastomer plates 4 and steel plates 5, held between a bottom steel plate 6 and a top steel plate 7 designed to be connected to the base and to the structure to be supported, respectively, as schematically indicated by pin-type elements 8 and 9. Centrally, there is placed a lead core or plug 10, appropriately sized, constituting a plastically deformable portion, capable of absorbing most of the energy transmitted by a seism such as that caused by an earthquake. As it can be well seen in FIG. 11, the top plate 7 is part of the supporting portion 1 and moreover includes side projections 7' for attaching the coupling members 3, as it will be better described later on.

The plate 7 of the supporting portion 1 supports the pin-type elements 9 structure 9 through a corresponding plate 9' of the latter. Between the plates 7 and 9' a material with a low friction coefficient is placed, for example, a layer of polytetrafluoroethylene 11.

A deformed area of the plates 7 and 9' forms a rail 12 extending in the direction of maximum thermal dilatation, for example, parallel to a bridge (not shown) or viaduct (not shown) connected to the pin-type elements 9. The rail 12 as well can be provided with a friction-reducing coating and is received in a slot 40 in the plate 9'. Therefore, the plate 9' of the supported portion 2 is free to move with respect to the supporting portion 1 in the direction defined by the rail 12, that is perpendicular to the plane of the drawing in FIG. 1, and horizontally in the plane of the drawing in FIG. 2. It is clear that under such conditions the displacements due to thermal dilatations or expansions and occurring in the direction of the rail 12 are absolutely free, but there will not even be the possibility of an aseismatic action of the bearing 1 along said direction because the plate 9' will slip with respect to plate 7.

To obtain the latter result and at the same time to allow the displacements of the structure due to thermal dilatations, at least one of the coupling members 3 is placed between the plate 9' carrying the pin-type elements 9 and the plate 7' carrying the pin-type elements 8 (in the illustrated case, two couplers 3 in parallel are utilized. Each coupling 3 has the characteristic of coupling in a substantially stiff way, the supported portion 2 and the supporting portion 1 when forces of impact type take place, tending to move them reciprocally at high speed. These forces may be, for example, due to a seism or even to temporary strains caused by traffic. However, each coupling 3 allows for relative slow movements, such as those occurring under stresses acting for long periods of time, for example for thermal expansions or dilatations.

For these purposes, each coupling member 3 is essentially formed by a body 13 fixed by means of bolts 14 to the relevant projection 7' of the plate 7 on the supporting portion 1, said body defining or housing a cylinder 15 (FIG. 3), provided with heads 16 with airtight passages in 17 for a double stem 18 connected to a central piston 19. The two ends of the double stem 18 are screwed in fittings 20 within two blocks 21 which in turn are fixed, for example by way of bolts 22, to the plate 9' of the supported portion 2.

Figure 3:
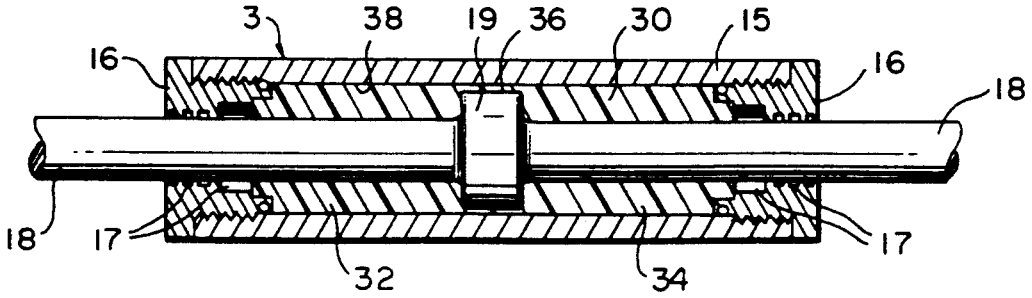
FIG. 3 is an axial section of the operative portion of a coupling member for coupling supporting and supported portions of the aseismatic support to one another via a mass of silicone gel.

As it can be noticed in FIG. 3, between the internal surface of the cylinder 15 and the external surface of the piston 19, a little clearance 36 is provided which creates a passage sufficient to allow a slow transfer of a substance from one side to the other of the piston 19, inside the cylinder 15. The substance which fills the cylinder must obviously be very viscous, and it is preferred to use a silicone jelly or silicone gel, already known in itself, having the consistency of a plastiline and having the characteristic of deforming under low pressure but of becoming stiff under impact.

In this way, the supported portion 2 carrying the pin-type elements 9 remains rigid with respect to the aseismatic support for all the stresses having characteristics of impact or in any case lasting only for short periods of time, while it is free for sliding in the direction of extent of the rail 12 under the action of thermal dilatations, whatever the resulting displacement may be.

In summary, the aseismatic support of the invention includes a supporting portion comprised of the aseismatic bearing which includes alternate steel and elastomer plates 4 and 5 and the deformable lead plug 10. The first portion is anchored to the ground by pin-type elements 8. The supported portion 2 having the plate 9' rests on the supporting portion 1 and is guided to move in one direction by the rail 12 received in the slot 40. The supported portion 2 is connected by projections 9 to a structure, such as a bridge or the like, being supported in accordance with the principles of the instant invention by the aseismatic support.

The supported portion 2 is connected to the supporting portion 1 through couplings 3, which couplings comprise a cylinder 15 (FIG. 3) providing a first component which is fixed to the supporting portion 1 by bolts 14. A piston 19 provides a second component fixed to the supported portion 2 by stems 18 threaded into blocks 21 and connected by bolts 22 to the plate 9'. Within the cylinder 15 there is disposed a material such as silicone putty or gel 30 (FIG. 3) which is plastically deformable by slow movements of the piston 19 but exhibits stiff behavior under fast movements of the piston. When in the plastic state, the silicone putty flows from one chamber 32 to the other chamber 34 of the cylinder 15, and vice versa, passing around the piston 19 by flowing through the gap 36 between the piston 19 and the inner wall 38 of the cylinder. In this way, the aseismatic support accommodates thermal expansions by allowing movement as well as absorbing earthquake tremors by becoming stiff to transfer forces to the lead plug 10 and the stack of alternating elastomer and steel plates 4 and 5, respectively.

It must be noticed that the latter displacements do not at all affect operative conditions, the position or lay of the aseismatic bearing and, therefore, it always remains in optimal operational conditions and is never partially deformed as in the cases of the known technique in which the structure subject to dilatations or expansions is rigidly connected to the support. From the preceding description, it is obvious that all the components of the assembly: aseismatic bearing, guide and coupler can have reciprocal configuration and arrangement different from those herein described without departing from the spirit and scope of the present invention.

I claim:

1. An aseismatic support for supporting a structure subject to slow displacements along one direction, such as displacements due to thermal expansions, comprising:

a supporting portion, said supporting portion comprising a plurality of steel and elastomer plates and a central lead plug mounted between an upper and a lower steel plate;

a supported portion, secured to said structure, slidingly mounted on said supporting portion and movable in said one direction;

a rail received in a slot disposed between said supported and supporting portions to limit displacements to said one direction;

anti-friction material disposed between said supported and supporting portions proximate said rail to facilitate relative displacements of said supported and supporting portions;

a hollow, closed cylinder secured to said supporting portion, the cylinder housing a piston provided with oppositely directed stems, which stems are secured to said supported portion, said piston being reciprocable within said cylinder under displacement of said portions of the aseismatic support and defining within said cylinder two chambers of variable volume interconnected by a reduced size passage provided between an internal surface of the cylinder and an external axially extending surface of the piston; and a silicone putty filling said cylinder.

2. An aseismatic support supporting a structure subject to slow displacements along one direction such as displacements due to thermal expansions, comprising:

a supporting portion;

a supported portion secured to said structure, said supported portion being mounted on and movable with respect to said supporting portion along said one direction;

a guide having high smoothness disposed between the portions for guiding relative displacements in said one direction;

a coupling having a first component secured to said supporting portion and a second component secured to said supported portion; and said coupling including a deformable material disposed between the first and second components, the deformable material being plastically deformable under slow movement of the components with respect to one another and being substantially stiff under fast movements of the components with respect to one another.

3. An aseismatic support according to claim 2 wherein said guide comprises a plate coated with anti-friction material and at least a rail extending in said displacement direction.

4. An aseismatic support according to claim 3, wherein the deformable material is silicone putty.

5. An aseismatic support according to claim 2, wherein said first component of said coupling comprises a closed cylinder fixed to one portion of the aseismatic support; said second component of said coupling comprises a piston housed within said cylinder and defining two chambers of variable volume in said cylinder, the piston having a stem fixed to the other portion of the aseismatic support, and wherein said deformable material has high viscosity index for relatively slow passage through a restricted passageway defined by said piston connecting said two chambers of said cylinder.

6. An aseismatic support according to claim 5, wherein the restricted passageway is provided between an internal surface of the cylinder and the external surface of the piston.

7. An aseismatic support according to claim 6, wherein the deformable material is silicone putty.

8. An aseismatic support according to claim 7, further comprising a plastically yielding device with permanent deformation disposed in said first portion.

9. An aseismatic support according to claim 8, wherein said plastically yielding device comprises a plurality of steel and elastomer plates and a central lead plug.

* * * * *